United States Patent [19]

Kurzinski

[11] Patent Number: 4,483,385

[45] Date of Patent: Nov. 20, 1984

[54] SYSTEM FOR OSCILLATING MOLD TUBE IN CONTINUOUS STEEL CASTING MACHINE

[75] Inventor: Cass R. Kurzinski, Milford, Pa.

[73] Assignee: AMB Technology, Inc., New York, N.Y.

[21] Appl. No.: 318,380

[22] Filed: Nov. 5, 1981

[51] Int. Cl.[3] ..... B22D 11/04; B22D 11/124; B22D 27/08

[52] U.S. Cl. ..... 164/416; 164/443

[58] Field of Search ..... 164/416, 260, 478, 443, 164/485

[56] References Cited

U.S. PATENT DOCUMENTS 2,683,294 7/1954 Ennor et al. ..... 164/488

3,805,878 4/1974 Bashkov et al. ..... 164/416

FOREIGN PATENT DOCUMENTS 896988 11/1953 Fed. Rep. of Germany ..... 164/416

*Primary Examiner*—Nicholas P. Godici

*Assistant Examiner*—J. Reed Batten, Jr.

*Attorney, Agent, or Firm*—Dennis H. Lambert

[57] ABSTRACT

A mold tube is contained within an open water-cooling vessel, and the tube is cooled by directing water sprays at it. Because of the use of a water-cooling system which does not require a pressure-tight integral mold tube/water system, the cooling system may remain stationary while the mold tube is oscillated. In this way the oscillating mechanism can be relatively inexpensive, the total weight which must be moved up and down typically being in the range of 80–200 pounds.

4 Claims, 1 Drawing Figure

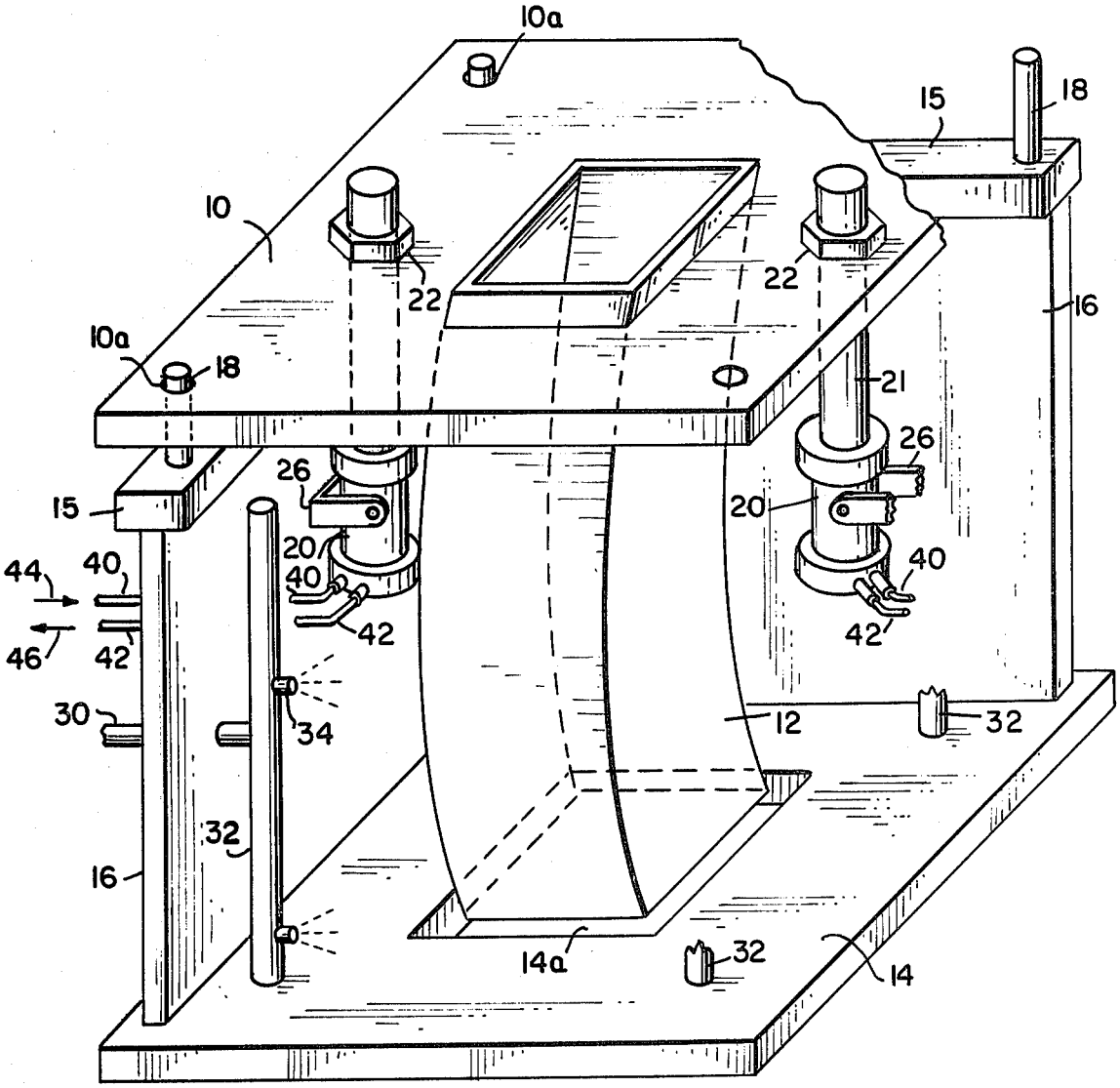
10a
15
18
10
22
22
16
10a
18
21
26
26
15
20
20
40
40
44
40
42
42
46
42
30
34
12
32
32
16
14a
32
14

SYSTEM FOR OSCILLATING MOLD TUBE IN CONTINUOUS STEEL CASTING MACHINE

DESCRIPTION

This invention relates to high-temperature metal continuous casting machines, and more particularly to systems for oscillating the mold tubes contained therein.

In the conventional continuous steel casting method, molten steel is passed through a vertically-oriented, usually curved, copper mold (which is typically square-shaped, although it may be rectangular in the event steel slabs are to be made). As the molten steel passes through the mold its outer shell hardens. As the steel strand continues to harden, it is bent through an angle of 90° so that it moves horizontally, and it is subsequently cut into individual billets.

The temperature of molten steel is typically 2850° F., although with certain grades the temperature may be as low as 2600° F. In general, although most of the references herein are to steel casting, my invention contemplates the casting of any metal or metal alloy whose liquid temperature exceeds 2600° F.

The mold which forms the steel strand contains the liquid steel and provides for its initial solidification, that is, hardening of the outer shell. The solidifying strand is extracted continuously from the bottom of the mold at a rate equal to that of the incoming liquid steel at the top, the production rate being determined by the time required for the outer shell to harden sufficiently so as to contain the inner core of liquid steel by the time the mold is exited. The liquid steel is cooled in almost all present-day casting machines by providing a water system which circulates cooling water around the mold. The water enters at the bottom of a pressure-tight vessel which surrounds the mold and travels upward in a direction opposite to that of the moving liquid steel. The "counter-current" water flow has been found to be most efficient for heat transfer in continuous steel casting machines.

The cooling water is under high pressure and flows at a high velocity, for reasons to be described below. This necessitates that an enclosed, usually welded, pressure-tight vessel be employed. The copper mold is usually fixed to the pressure-tight vessel at both of its ends so that the cooling system is completely sealed. Should the mold melt at any point and the liquid steel contact the cooling water, a steam explosion results. Thus, it is essential that sufficient heat be extracted from the liquid steel through the copper mold by the water flow.

A considerable amount of work has been done in the prior art and much is known about the heat transfer process which occurs in the above-described cooling system. As heat is transferred from the liquid steel to the flowing water through the walls of the copper mold, some of the water heats up to its boiling point. The resulting steam creates a barrier which prevents the continued flow of substantial quantities of heat through it from the copper mold to the cooling water. In order to increase the heat extraction rate and prevent the hot molten steel from melting through the copper mold tube, it is generally accepted by those knowledgeable in the field that the only reliable method of eliminating the steam barrier is to flow water at a high velocity along the face of the copper mold tube. It has been calculated and proven in operation that a linear velocity of 21–25 feet per second cooling water flowrate is necessary to result in turbulent flow conditions so as to effectively sweep the steam barrier from the copper tube/water interface. From a practicality standpoint, this consideration further requires that the film thickness of the cooling water be typically 3/32 inch.

In the abandoned application of Kurzinski et al, Ser. No. 106,894, filed on Dec. 27, 1979 and entitled "Continuous Metal Casting Machine and Method", which application is hereby incorporated by reference, there is disclosed a continuous casting machine whose copper mold is secured to the surrounding frame only at the top. The bottom of the mold is not secured in the frame in order to facilitate mold replacement. Because the bottom of the mold is not secured to the frame, an enclosed pressure-tight cooling system cannot be provided around the mold tube. Instead, the mold is sprayed with jets of water, the water being collected at the bottom of the mold tube or even allowed to drip down along the strand.

The advantages of such a design will be apparent to those skilled in the art; mold tube changes are greatly facilitated and costs are reduced substantially. However, the system described in said application, when first tested, proved to be impractical, at least without the refinements to be described herein. A similar spray-cooling system was disclosed in Ennor et al U.S. Pat. No. 2,683,294. But the Ennor et al system was designed for use with the casting of low-temperature metals; the Ennor design allowed for large areas of unsprayed and hence uncooled mold surface (which is of little concern when low melting point metals are cast but of major importance when high temperature metals are cast). When the molten metal has a temperature of at least 2600° F., there is so much heat to be extracted that the Ennor et al system is ineffective and dangerous.

The problem is that some of the water spray turns to steam when it strikes the hot outer mold surface, and the steam serves as a barrier to substantially reduce the amount of water which penetrates it to the mold. From experimentation with continuous casting molds made of copper alloys and casting high temperature metals, it was determined that when temperatures on the copper/water interface exceed 400° F. at the meniscus the mechanical properties and stability of the copper mold degrade substantially. This results in detrimental effects to the cast strand itself. Unless the cooling medium directly impacts upon the copper mold or has sufficient velocity along the mold surface to ensure that heat contained within the mold is properly extracted, then the temperature of the mold itself will continue to rise beyond the 400° F. level, ultimately reaching the melting point of the mold itself, and allow the liquid metal being cast to break through the mold and react violently with the cooling medium. It appeared from early experiments that the prior art high-pressure, turbulent water flow technique was essential to sweep the steam barrier away from the outer face of the hot copper tube.

In my copending application Ser. No. 299,999, entitled "Spray Cooling System For Continuous Steel Casting Machine", filed on Sept. 8, 1981, which application is hereby incorporated by reference, there is disclosed a water spray system for cooling the mold tube in a continuous casting machine used to form continuous strands of metal whose molten temperature exceeds 2600° F. As described in my aforesaid application, the advantages of an open mold-containing system, by using a water-spray technique can be achieved only by carefully selecting certain critical parameters. It is the utilization of a unique set of certain critical operating variables that permits a water spray system not only to effectively result in satisfactory heat transfer, but also to accomplish the operation more efficiently than with the prior art flowing-film technique. The hardened strand shell is thicker at the end of the sprayed mold that it is in a comparable prior art system operated at the same rate. This means that the cast strand can even be extracted at a faster rate than in a comparable prior art system without any loss of quality or any increased danger to operating personnel.

In the conventional casting process, it is necessary to oscillate the mold in order to ensure that the solidifying metal does not adhere to the mold surface; solidifying steel, if it adheres to the copper mold surface, will cause the steel skin to rupture and ruin the cast structure. In the prior art, molds are usually oscillated at 60–80 oscillations per minute, depending upon solidification factors, size and withdrawal rate of the steel being cast. The frequency of oscillation is usually increased as the strand speed increases. A lubricant such as rapeseed oil or a high-melting point powder composition (the latter being more commonly used when very large cross sections are being cast such as those for slabs and blooms) is applied either automatically or manually to the meniscus of the liquid steel in the mold. As the mold assembly moves in the upward direction of its oscillatory motion, new copper mold surface is exposed above the meniscus level. The lubricant adheres to this exposed surface and forms the lubricating surface layer between the solidifying steel strand and the copper mold wall. The lubricating layer serves the additional purpose of creating a heat-transfer layer between the solidifying steel and the mold wall to better enhance steel solidification.

In the conventional prior art continuous steel casting machine, in which a counter-current turbulent water flow is achieved by providing for a high linear velocity flow rate (typically in the range of 20–30 feet per second), the mold must be designed as an integral high-pressure, water-tight structure, with a complex series of baffle jackets to ensure that the necessary flow velocities are achieved. Typical baffle-tube-water-channel designs require very heavy structures. More important, the requirement than the system be pressure-tight means that the cooling water system has to be an integral part of the mold itself. This, in turn, requires that the entire cooling system be oscillated together with the mold. The entire system may weigh from 2,000 to 4,000 pounds and to oscillate the mold as required necessitates the use of a large motor, and usually a complex system of gear reducers, eccentric cams, bearings and associated electrical and instrumentation systems. All of this is required despite the fact that the only thing which has to be oscillated, from a metallurgical standpoint, is the mold tube itself and its supporting structure, whose combined weight is typically 80–200 pounds.

It is a general object of my invention to provide a continuous steel casting machine in which the mold tube is oscillated without the attendant oscillation of a pressure-tight water cooling system.

As disclosed in my copending application, the mold tube is secured to a supporting plate at its top; the bottom of the tube is not secured to any kind of a frame. Surrounding the mold tube, a series of vertical pipes is provided for spraying the mold tube via a plurality of nozzles. The placement of the nozzles relative to each other and relative to the mold tube must be carefully controlled as described in my copending application. But given a properly-constructed spray system, it is apparent that the spray system is not an integral part of the mold tube structure. In accordance with the principles of my present invention, the mold tube, attached to a supporting plate at the top, simply oscillates within the spray system. Consequently, by utilizing a spray system within an open frame as disclosed in my copending application, it is necessary only to oscillate the mold tube itself, and no part of the cooling system. It is this feature which allows a highly cost-effective oscillating mechanism to be employed.

Further objects, features and advantages of my invention will become apparent upon consideration of the following detailed description in conjunction with the drawing, which drawing depicts in perspective view the illustrative embodiment of my invention.

It is to be understood that the drawing depicts only the mold tube/water-cooling sub-systems of an overall continuous casting machine; mechanisms for pouring molten steel into the mold tube, for transporting cast strands from the exit end of the tube, etc., are well known to those skilled in the art. The frame for the cooling system includes a bottom plate 14, with a central cut-out 14*a*. Several side walls, such as 16 may be provided around the periphery of the bottom plate 14; it is not necessary that the side walls completely enclose the mold tube 12, although for support purposes there should be at least one section of a side wall along each edge of bottom plate 14. The bottom plate is fixed in the overall casting machine.

Along the upper edges of the side walls is a frame 15, and at the four corners of the frame there are disposed guide pins 18. Upper plate 10 is provided with four holes 10*a* at its edges, the upper plate thus fitting on the four guide pins 18. The guide pins serve to guide the upper plate as it is oscillated in an up-and-down direction. Mold tube 12 is fixed to a central cut-out in the upper plate so that the mold tube is oscillated up and down along the upper plate.

Four pipes 32 (only one of which is shown in its entirety) are mounted in the vertical direction as shown, each pipe having a series of nozzles 34. These nozzles serve to spray the corners of the mold tube with cooling water, as described in my copending application. The water inlet 30 for each pipe 32 extends through a side wall such as side wall 16.

An air cylinder 20 (although an hydraulic cylinder can also be used) is mounted by a bracket 26 to side wall 16. A similar air cylinder is mounted in a comparable manner to the side wall (not shown) on the right side of the drawing. Air inlet tube 40 and air outlet tube 42 extend from the air cylinder through wall 16 to the outside of the frame. The arrow 44 is intended to depict a source of air, air escaping from the air cylinder exiting in the direction of arrow 46. Each air cylinder has a piston 21 which is mounted by a nut 22 to the upper frame 10; a similar nut 22 (not shown) is provided at the bottom of the upper plate for securing the respective piston. It is the application of air pressure to each air cylinder that causes the respective piston to be raised; the weight of the upper plate and the mold tube then forces the piston down and expels air from the respective cylinder during the downward portion of each stroke. It is in this way that the upper plate and the attached copper tube, which typically weigh 80–200 pounds, can be oscillated by a relatively simple and low-cost oscillating mechanism; it is the fact that the water cooling system need not be oscillated since it does not form an integral unit with the upper plate and the mold tube, as in the prior art, that greatly simplifies the construction. Instead of employing air or hydraulic cylinders, it is envisioned that small motors will also be sufficient for oscillating the light load.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A continuous casting machine for casting metals whose melting point temperature is in excess of about 2,600° F., comprising: an open, stationary housing including a bottom wall having an opening therethrough and upstanding side walls projecting upwardly from the bottom wall, defining an open top to the housing; at least one upstanding guide pin on the upper end of the side walls; drive means carried by the open housing and including movable members projecting upwardly in the housing and movable in an up and down direction relative to the housing; a movable top plate having an opening therethrough and carried by the movable members for up and down movement with the movable members in a position overlying the open top of the housing and having at least one guide opening aligned with said at least one guide pin and receiving the guide pin therethrough for guiding the top plate in its up and down movement; a mold tube having an upper end secured to the top plate in registry with the opening, for up and down movement with the top plate, and having a free lower end aligned with the opening in the bottom wall; and spray means fixed to the housing in spaced relationship around the mold tube and extending upwardly in the housing for spraying the exterior surface of the mold tube to cool molten metal therein as the mold tube is moved by the movable members in an up and down direction relative to the housing and spray means.

2. A continuous casting machine in accordance with claim 1, wherein there are a plurality of guide pins and aligned guide-pin-receiving openings.

3. A continuous casting machine in accordance with claim 2, wherein the drive means comprise a plurality of piston and cylinders arranged on opposite sides of the mold tube; and the movable members comprise actuating rods connected with the pistons and with the top plate.

4. A continuous casting machine in accordance with claim 3, wherein the piston and cylinders are pneumatically operated.

* * * * *